US007234277B2

(12) United States Patent
Savin

(10) Patent No.: US 7,234,277 B2
(45) Date of Patent: Jun. 26, 2007

(54) ANTI-SEISMIC RESCUE APPARATUS

(76) Inventor: Nicolae Savin, Str. Domneasca 36, bl Select, ap. 6, Galati (RO) 800008

( * ) Notice: Subject to any disclaimer, the term of this patent is extended or adjusted under 35 U.S.C. 154(b) by 200 days.

(21) Appl. No.: 10/991,251

(22) Filed: Nov. 17, 2004

(65) Prior Publication Data

US 2005/0116104 A1 Jun. 2, 2005

Related U.S. Application Data

(63) Continuation of application No. PCT/RO02/00024, filed on Nov. 28, 2002.

(30) Foreign Application Priority Data

May 17, 2002 (RO) ..... 02-00617

(51) Int. Cl.
*E04H 1/00* (2006.01)

(52) U.S. Cl. ..... 52/79.12; 52/DIG. 12; 52/105; 52/125.2; 52/167.1

(58) Field of Classification Search ..... 52/79.1, 52/167.1, 167.4, 167.9, 169.6, 167.7, 79.12, 52/105, 125.2, DIG. 12; 109/49.5; 182/70, 182/76

See application file for complete search history.

(56) References Cited

U.S. PATENT DOCUMENTS

| | | | | |
|---|---|---|---|---|
| 2,607,047 A | | 8/1952 | Posey | |
| 4,490,864 A | * | 1/1985 | Wicker, Jr. | 5/9.1 |
| 5,867,947 A | | 2/1999 | Holtz Hale et al. | |

(Continued)

FOREIGN PATENT DOCUMENTS

| | | |
|---|---|---|
| FR | 2 731 033 A1 | 8/1996 |
| JP | 08326349 A | 12/1996 |
| RO | 117 271 B | 12/2001 |

OTHER PUBLICATIONS

Thomas Paulay et al.: "Proiectarea structurilor de beton armat la actiuni seismice" the projection of ferro-concrete structures to the seismic actions, Ed. Tehnica, 1997, pp. B 10-11, F 64-66, and English translation of relevant parts.

(Continued)

*Primary Examiner*—Carl Friedman
*Assistant Examiner*—Jonathan Junker
(74) *Attorney, Agent, or Firm*—Laurence A. Greenberg; Werner H. Stemer; Ralph E. Locher

(57) ABSTRACT

A rescue apparatus mounted inside buildings where people currently live and spend their activities and in regions with high seismic potential includes a rescue cabin with a reinforcing frame, covered on an exterior side with corrugated iron and on an interior side with plastic fire-resistant and with low grade of softness material. The cabin has compartments, in which there is a chair with head support, a backrest, a safety harness, and a crash helmet. For damping vertical shocks, under each chair is a damper spring. Access into the cabin is accomplished by two doors with contradiction opening and vertical rotation axles solidly with the two central doors of the furniture part by a lever device and open together therewith. Each door has a locking mechanism driven from inside or outside the cabin. An upper part of the cabin has windows for ventilation, each equipped with a screen filter for dust.

28 Claims, 4 Drawing Sheets

U.S. PATENT DOCUMENTS

| | | | | |
|---|---|---|---|---|
| 5,956,907 | A * | 9/1999 | Martin | 52/169.1 |
| 6,101,769 | A * | 8/2000 | Hamill | 52/167.1 |
| 6,298,503 | B1 * | 10/2001 | Hsu | 5/2.1 |
| 6,349,508 | B1 * | 2/2002 | Ju et al. | 52/79.1 |
| 6,374,553 | B1 * | 4/2002 | Johnson | 52/169.6 |
| 6,539,674 | B2 * | 4/2003 | Arnold | 52/79.1 |

OTHER PUBLICATIONS

Dubbel: "Manual Inginerului Mecanic" [Handbook of mechanical engineering], Editura Tehnica, Bucuresti, 1998, pp. 26-27, 75-77, and English translation of relevant parts.

* cited by examiner

ANTI-SEISMIC RESCUE APPARATUS

CROSS-REFERENCE TO RELATED APPLICATION

This is a continuing application, under 35 U.S.C. § 120, of copending international application No. PCT/RO02/00024, filed Nov. 28, 2002, which designated the United States; this application also claims the priority, under 35 U.S.C. § 119, of Romanian patent application No. 02-00617, filed May 17, 2002; the prior applications are herewith incorporated by reference in their entirety.

BACKGROUND OF THE INVENTION

Field of the Invention

The invention refers to an anti-seismic rescue apparatus that can be assembled into buildings (e.g., dwellings, social-cultural, office buildings, etc.) where people live and usually carry out their activities. In particular, the apparatus can be placed in buildings that have a high degree of seismic risk or are in high seismic risk regions.

The buildings subjected to seismic actions must provide protection of the people who live and spend time therein. But paradoxically, the lives of people who are caught unguarded by major earthquakes in those buildings are threatened by the buildings or by the buildings' component parts, in cases where the buildings are caving in or are damaged seriously.

The reasons why buildings are not resistant to earthquakes are various and they generally are related to the structural design, to the seismic action, to the way the action is imparted, and, also, to the earthquakes' magnitude in fact, which, sometimes, can exceed the magnitude of the earthquake and to its cyclic repetition. Thus, if a building resisted well to one or two earthquakes of high magnitude, it is very possible that t will not resist well to the next one because the ductile elements suffered reciprocal deformations and changed place with every major seismic movement. The buildings' demolition becomes necessary after receiving a cycle of major earthquakes—solutions that suppose big financial efforts and a very long time of immobilization.

Human lives are lost due to directly receiving strikes on one side or the other and many lives are lost because the person cannot survive a long time without water, food, warmth, etc., and the rescue operations usually last long time.

French Patent 273 10 33 discloses an anti-seismic cell for protection and survival, the cell having a parallelepipedal shape that can be integrated into a building. The drawbacks of the disclosed solution include the fact that the cell occupies a large space. It also cannot be integrated into small spaces of a block of apartments, residences, and/or flats, and it cannot be dissembled as a furniture piece either. Also, because of its parallelepipedal shape, it will take over a bigger part of the compression effort exerted against it by the superior parts of the building and even some of the resultants of the equivalent seismic forces. The dimensioning should be done to very big forces, and in this case, its clearance diagram is very high as well. Also, because of its parallelepipedal shape, the cell cannot be quickly extracted from the wreckage before it is cleared.

SUMMARY OF THE INVENTION

It is accordingly an object of the invention to provide an anti-seismic rescue apparatus that overcomes the hereinaforementioned disadvantages of the heretofore-known devices of this general type and that provides an anti-seismic shelter having small dimensions that can be mounted and remain permanently into the areas lived by people, that can resist and protect its occupants in case of a building cave-in, and that can ensure, at the same time, conditions of survival, communication with the exterior, and quick rescue from the building wreckage.

With the foregoing and other objects in view, there is provided, in accordance with the invention, an anti-seismic rescue apparatus to be placed in a room of a structure for protecting at least one occupant from shocks and impacts during seismic activity, for ensuring communication with the environment, for improving survival of the occupant from seismic activity during a period of time, and for improving conditions for a faster rescue of the occupant and their valuables caught inside the damaged structure, the apparatus including a rescue device having a rescue cabin defining a interior for accommodating at least one occupant and having in the interior survival devices for surviving burial and for assistance in rescue, a reinforcing frame protecting the rescue cabin from at least a first impact caused by seismic activity, a supporting system having connections releasably connected to the reinforcing frame for releasing the rescue cabin from the supporting system, and at least one of the reinforcing frame and the supporting system maintaining the rescue cabin in a substantially vertical position while the room keeps its integrity, a piece of furniture containing the rescue cabin therein and camouflaging the rescue cabin to harmonize the rescue cabin with an existing environment of the room, and a towing device connected to the rescue cabin for locating the rescue cabin and for quarrying out the rescue cabin from wreckage.

With the objects of the invention in view, there is also provided an anti-seismic rescue apparatus to be placed in a room of a structure for protecting at least one occupant from shocks and impacts during seismic activity, for ensuring communication with the environment, for improving survival of the occupant from seismic activity during a period of time, and for improving conditions for a faster rescue of the occupant and their valuables caught inside the damaged structure, the apparatus including a rescue device having rescue cabin defining a interior for accommodating at least one occupant and having in the interior survival devices for surviving burial and for assistance in rescue, the rescue cabin having at least one door selectively opening and closing off the interior for access to and egress from the interior by the occupant, a reinforcing frame protecting the rescue cabin from at least a first impact caused by seismic activity, a supporting system having connections releasably connected to the reinforcing frame for releasing the rescue cabin from the supporting system after a given force is exerted through the connections, and at least one of the reinforcing frame and the supporting system maintaining the rescue cabin in a substantially vertical position while the room keeps its integrity, a piece of furniture containing the rescue cabin therein and camouflaging the rescue cabin to harmonize the rescue cabin with an existing environment of the room, and a towing device connected to the rescue cabin for locating the rescue cabin and for quarrying out the rescue cabin from wreckage, the towing device having a structure sufficient to quarry out the rescue cabin from wreckage.

The whole anti-seismic system of the present invention is camouflaged into a piece of furniture having the shape of a wardrobe with four doors, made by solid wood or imitation wood in the same stylistic line with the existent furniture of the house.

The anti-seismic apparatus according to the invention removes the drawbacks mentioned above because it is constituted from a rescue cabin built up by a reinforcing frame resisting enough of the shocks and hits of the building component parts. The apparatus is covered by reinforcement plate or corrugated iron and is internally upholstered with fireproof plastic material and plastic foam having a heat-resisting quality with a high degree of softness that does not produce harm to the body zones that come in contact with the apparatus. Two compartments lodge two persons sitting on two chairs placed back to back, one chair for each compartment. The chair has side head support, a backrest, a headrest, and side head support. Each chair is equipped with full safety harness, a crash helmet and damper springs for the damping, vertical shocks. The chairs are able to slip over columns placed by the separator plane between the compartments. Access into the cabin is accomplished by two doors with contradiction opening and vertical rotation axles. The doors are directly coupled with the two central doors of the furniture part by a lever device and open together with them on their command. The doors have a locking mechanism that can be driven from inside or outside the cabin and are protected from hitting by a linear recess. The doors have framework structures, sustained and held against moving inside by a subframe into the side walls of the cabin. Under the chairs are deposit spaces covered with protecting covers secured with screws, where the apparatus, the installations, the materials, the food and the water needed for survival can be stored up. At the upper side of the cabin there are four circular windows for ventilation, each of them endowed with a screen filter for dust. The windows are protected from striking and against obtrusion by a linear shim with high endurance, mounted normally at the exterior surface of the cabin on some main plates. The cabin is equipped on the underside with four dampers with impact springs and each lateral edge of the frames has welded a carbide-tipped tool for the dislocation of the ferro-concrete blocks and kinetic energy dissipation. The vertical cabin stands, as long as the chamber where the cabin is been placed keeps its integrity and is realized by a supporting system that also protects the cabin from shocks and can quickly set it free when it will be necessary. The whole ensemble is camouflaged by a furniture piece. The cabin may be taken out from wreckage by a towing device.

In accordance with another feature of the invention, the part that represents the reinforcing frame is built up by four steel frames with ringshaped section, each of them made up by three sections welded under some angles and joining together at the upper part into a pyramidal pike and at the inferior side each of them being solidly with a damper with impact springs, with normal axle on the ground. Their dashpot pistons rely on circular supporting bracket for decreasing the pressure on the interior floor. The spatial disposition of the frames is a horizontal section occupying a rhombus angles and, vertically they generate a body—the rescue cabin's body—which has, from the base to the top, the shape of a prism; frustum of pyramid, pyramid. The frames are united by steel trellis with ringshaped section and gusset plates by welding. Joining is made up on the side faces of the cabin and on the vertical plane that contains the small diagonal of the rhombus base, which becomes the separation plan between the two cabin's compartments. As such, the apparatus has an indestructible structure frame works spatially coupled in a triangle shape. On the lateral edges of the frames are mounted, by welding, carbide tipped tools for dislocating ferroconcrete blocks with a certain speed that have contact with the cabin and for dissipating the kinetic energy.

In accordance with a further feature of the invention, the cabin's Supporting system is formed by tour supporting pillars made from steel with ringshaped section, placed by twos on one side to another of the rescue cabin, coupled with junction plates attached on the pillars with some clevis bolts, the crown nuts and the splints, attachment which permits a plan-parallel movement of pillar pairs, imitating in this way the oscillations of the floors during earthquakes. The bottom of the pillars pressing up on the interior floor contacts with flanges fixed with concrete anchor bolts by rubber buffer plates for damping shocks. At the superior side, the contact is carried out by slip-on flanges with milled recess, preventers, single coiled springs, flanges, damping rings solidly with steel tension rods having a length that can be regulated by screwing on screwing nuts solidly with the supporting pillars by adjustment holes. The pillars maintain the cabin in vertical position only as long enough as the room keeps its integrity by elastic arms and, each of them formed with sliding bars that support at the load side by a turning joint. A steering pad is on the interior side with two cover plates made from antifriction material that are permanently maintaining the elastic contact with the cabin. Its oscillations are transmitted to the sliding bars that are slipped over inside the bracket support solidly with one of the exterior junction plate with co-axial holes having oilite bushing. The elastic contact is ensured by single coil springs that lean on the spring hanger solidly with the sliding bars. The sliding bars' free end is equipped with thread cuttings and crown nuts and splints.

In accordance with an added feature of the invention, the towing device is formed by a wire cable with a section large enough to support the tensile stress tension for quarry out the rescue cabin from wreckage. An end is fixed on the rescue cabin by a draw hook with protection against cable detachment. The hook can be fixed on the top of the cabin by a screw nut and spring washers and an axle collar on plates. The other free end of the cable is caught outside through a hole made into the exterior wall of the room, goes vertically on the front of the building, and is fixed above in the highest point of the building that it is supposed to remain outside after its crumbling. The cable is marked from meter to meter all along starting from the top of the rescue cabin to the superior end to indicate a distance from the surface to the rescue cabin. At the end fixed on the building is attached a designation card that will have marked on it: the owner's name, the flat number, the floor, the relative position of the cabin to the front of the building, the phone number from the cabin, etc.

In accordance with an additional feature of the invention, the part equipped with measures for survival, for communication with the exterior and for disengagement, in specific captivity conditions, is endowed with a low pressure compressor with diaphragm driven by a single phase commutator motor at 12 v. The compressor absorbs the air from outside and moves it inside the rescue cabin through a wire wrapped rubber hose fixed on the cabin by a reducing sleeve. The other end is fixed on the front of the building and has a dust catcher protected by a filter container. The engine is commanded by a starting switch, its energy being supplied by an accumulator having good leakage properties from the cabin's compartment. The accumulator might, itself, be supplied on a 220V earth outlet placed outside the cabin, with an optimized charging rectifier. The accumulator might also be loading two electric light lamps and at 12 v commanded by two switches and, a mobile phone and a radio receiver, provided also with their own batteries with the power of a 12 v convenience outlet. The cabin is also endowed with one or two battery lamps, two mine breathing masks which can be used in critical moments, a first aid kit, a fire extinguisher, a high power hydraulic jack, a shovel, an accessory kit, structural tongs for disengaging the cabin out of the wreckage with own means, a metallic case for depositing money and value deeds, jewelry, user instructions, the Bible, etc., preserved food and bottled water, blankets to resist against hypothermia, chemical substances for hygiene, toilet paper and boxes made of plastic with a cylindrical shape, threading lid, forming dimensional levels so that they can be completely introduced one into another and all together into only one box, the biggest one.

In accordance with a concomitant feature of the invention, the piece of furniture has the shape of a wardrobe made by solid wood or imitation wood and camouflages the whole rescue apparatus giving it an esthetic shape that allows it to be placed into the living rooms. The apparatus has four superior and four inferior doors: the central inferior doors and open together with the rescue cabin's doors solidly therewith by a lever device and having vertical rotation axles parallel with the cabin's doors and, having on the side walls the oblong holes and to permit the elastic arms and to oscillate. The plank is fixed on the ceiling and on the inferior floor by some wood support frames and with the bolts. Applied outside are wood cornices and, the whole piece of furniture has, generally, a low mechanical resistance compared to the rescue cabin.

Because the compression forces that act on the rescue apparatus in cases where the building caves-in can be very strong and because they cannot be determined exactly, the invention of the present application chooses a solution that limit a compression force produced by ferro-concrete blocks. Over this limit, the rescue cabin will not receive the kinetic energy of the building's elements and this energy will be dissipated.

In principle, two pieces taking contact one with the other by pressure are submitted to contact tensions.

Due to the shape of the rescue apparatus, in cases where a building caves-in, the plane surfaces of the ferro-concrete elements contact the steel vertexes of the steel tension rods from the supporting system in a previous stage and the steel blades of carbide tipped tool mounted on the lateral edges of the steel frames in a next stage.

The stress distribution in the contact area depends on the hardness of the rigid bodies that are taking contact. The mean values are calculated according to the formula:

$$\sigma_p F_n/A \text{ respectively } \sigma_p = F_n/A_{pr},$$

where $F_n$ is the normal force and $A_{pr}$ is the normal projected contact area on the force direction.

The pressure depends mostly on the loading case, which can be static load, floating load, pulsating load, etc.

The softer pieces will give up first for ferro-concrete elements having an ultimate compression strength tens of times lower than the long time creep limit of the steel with high endurance.

Introduced into the above formula, the following formula results:

$$\sigma_{rc} F_n/A_{pr} \text{ respectively } F_{n\ limit} = \sigma_{rc} \times A_{pr},$$

where $\sigma_{rc}$ is the ultimate compression strength of the ferro-concrete element.

The normal force submitted by the rescue cabin will be:

$$F_{nc} \leq F_{n\ limit} F$$

When this limit is reached, the ferro-concrete elements will be penetrated and production of cracking and shearing will result.

Because the ferro-concrete is a frangible material and the stress is dynamic, the cracking and the shearing will take place to an effort $\sigma_{rcnec}$, and, even lower, going to: $\sigma_{rc}/3$.

The followings considerations apply:

- the width of the contact area b, between the ferro-concrete blocks and the cabin is equal to the total thickness of the blade as if it is sharpened, that is, $b_w$=5 mm;
- the length of the contact area $l_w$=500 mm;
- $\sigma_{rc} \cong 35 N/mm^2$;
- the fact that the steel tension rods will be first to break up the ferro-concrete element is left aside, and if it is assumed that the element strikes the cabin directly, then:

$$F_{n\ limit} \cong 35 \times 5 \times 500 \cong 87{,}500 N.$$

As a result: $F_{n\ limit} \cong 87{,}5$ KN.

This maximum normal force will be taken over by the rescue cabin and it is almost 100 times lower than the load that should be taken over by a resistance wall in case of an earthquake.

The apparatus, according to the present invention, has the following advantages:

- it provides an efficient and permanent protection and improves the rescue conditions for people who are caught in the buildings that will be seriously damaged or destroyed by a major earthquake;
- the apparatus is free from the structural system of the building so it does not absorb the huge efforts induced to the building, for example, equivalent seismic forces such as the tangential forces, the overturning moments, and the torsion moments. As a result, the dimensioning will be smaller and new disequilibrium is not introduced between the mass point and the rigidity centers of the buildings;
- the shocks are damped by dampers;
- the maximum compression force submitted are limited to a value that can be tolerated by the cabin by the motion of penetrating and breaking up the ferro-concrete blocks;
- due to its shape, the rescue cabin can be quickly extracted from wreckage by a towing cable without requiring a clearing of the whole quantity of wreckage above the cabin;
- the cabin costs lower than protection units necessary for consolidation or construction of some buildings with high rigidity;
- there is centralized execution and easy assembly in a very short time (e.g., a few hours) without causing harming the environment of the room;
- the earth tremor does not cause the building's deterioration because the apparatus and the floor oscillate together.

Other features that are considered as characteristic for the invention are set forth in the appended claims.

Although the invention is illustrated and described herein as embodied in an anti-seismic rescue apparatus, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1B is a fragmentary side elevational view of an air supply device of the anti-seismic rescue apparatus according to the invention;

DESCRIPTION OF THE PREFERRED EMBODIMENTS

Figures 1, 1A:
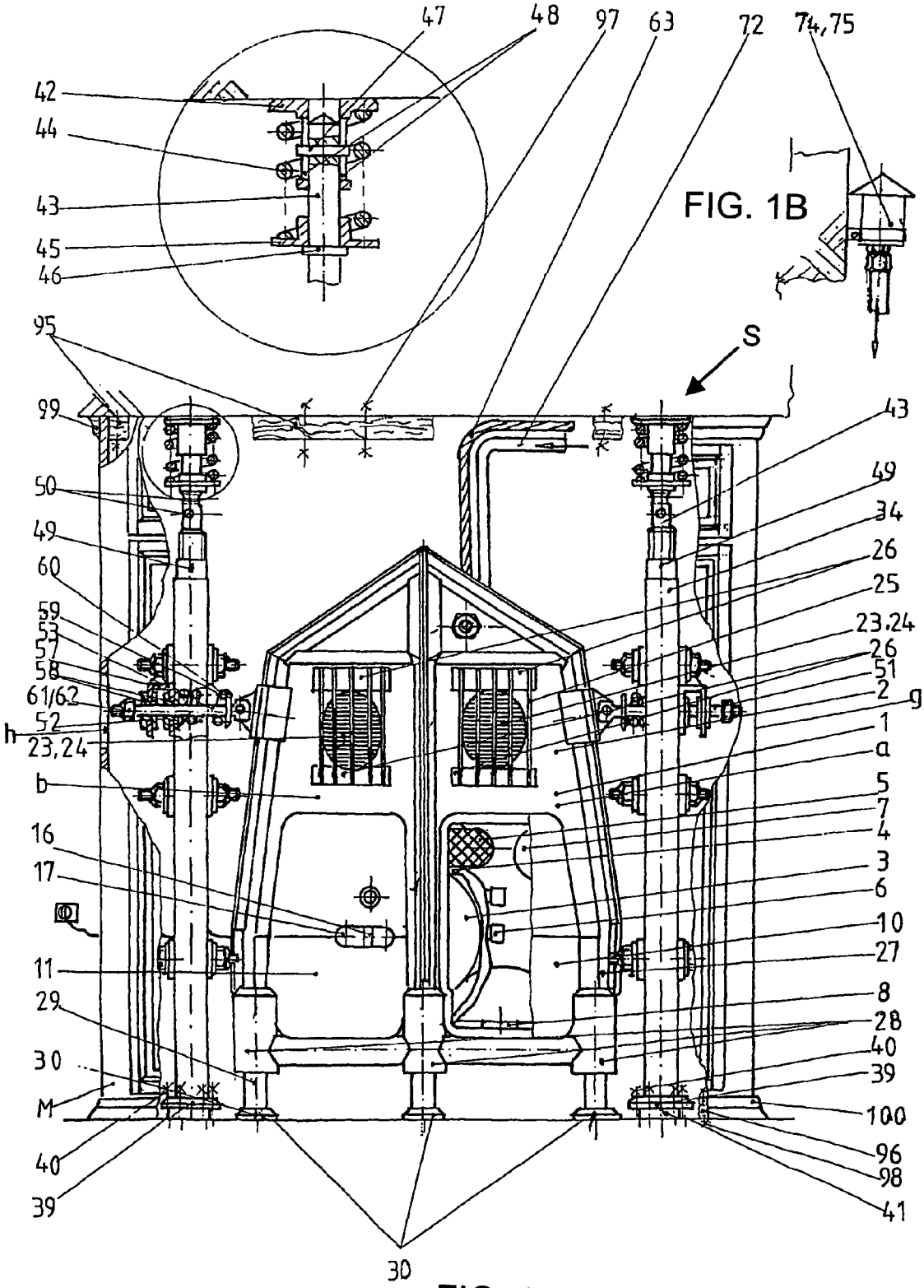
FIG. 1 is a side elevational view partially cut away of the anti-seismic rescue apparatus according to the invention.
FIG. 1A is an enlarged, fragmentary cross-sectional view of a portion of the frame of the anti-seismic rescue apparatus of FIG. 1.
Figure 3:
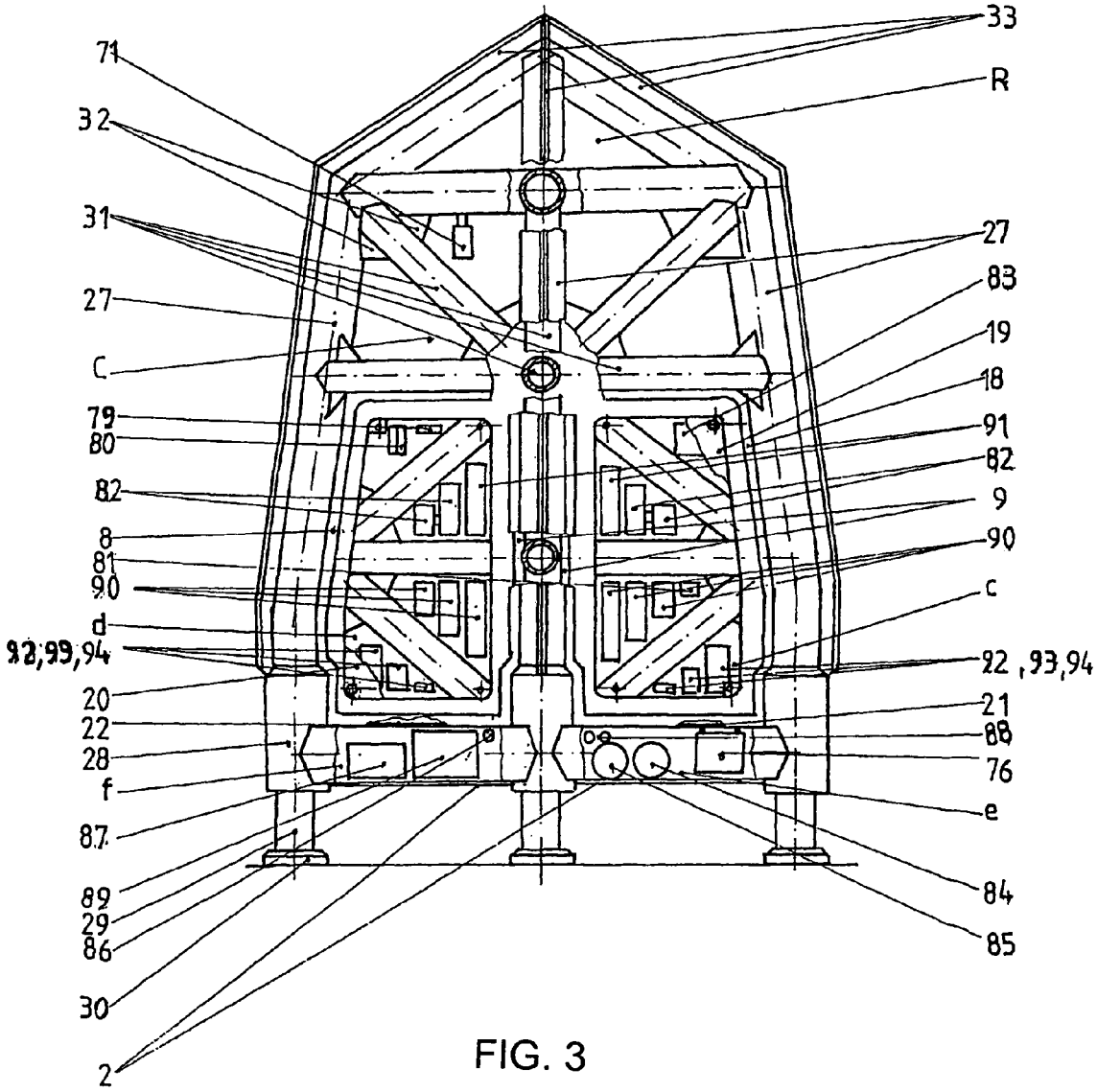
FIG. 3 is a cross-sectional view of the reinforcing frame and the depositing compartments of the rescue apparatus of FIG. 1.

Referring now to the figures of the drawings in detail and first, particularly to FIGS. 1, 1A, and 1B thereof, there is shown a first example of an anti-seismic rescue device according to the invention. The rescue device has a rescue cabin 1 with two compartments a and b able to shelter two people. The cabin 1 is built up from a reinforcing frame R covered by reinforcement plate or corrugated iron 2. See FIG. 3. At the interior side (see FIG. 3), the cabin has upholstered walls C for impact protection of the occupants and thermo-isolation of the cabin (achieved by a plastic fire-resisting material and plastic foam). The barrier-layer thickness is higher on the head, shoulders, and knees zones. In every compartment a or b of the cabin 1, is a chair 3 with a backrest, side head support, a headrest 4, and a side head support 5. Each of the chairs 3 has a full safety harness 6 and crash helmet 7.

For damping shock, the chairs 3 are equipped at the underside with damper springs 8, the oscillations being done vertically along some columns 9 placed on the separation plan between the two compartments a and b.

Access into the cabin 1 by a person is permitted by two doors 10 and 11 with contradiction opening and with vertical rotation axles, solidly with the two central doors 12 and 13 of the furniture' piece M, by some lever device 14 and 15, opening together with them on their command. Each door 10 and 11 of the cabin 1 has a locking mechanism 16 that can be driven from inside or outside the cabin and protected against hitting by a linear recess 17. The cabin's doors 10 and 11 have framework structures that rely on solid connection between the subframe 18 and the cabin 1, against moving inside as a result of hits from the outside.

Into the side walls of the cabin 1 and in the spaces under the chairs 3, there are some deposit compartments c, d, e, and f provided with some protecting covers 19, 20, 21 and 22 fixed by screws, where the apparatus, the installations, the devices, the materials, and the food and water needed for survival can be stored up and fixed against movement.

At the upper part of the cabin 1, there are four circular windows 23 endowed with screen filters for dust 24 and being protected from strikes and against obtrusion by linear shims 25 having high endurance and strength mounted normally at the exterior surface of the cabin 1 on some main plates 26.

Figure 2:
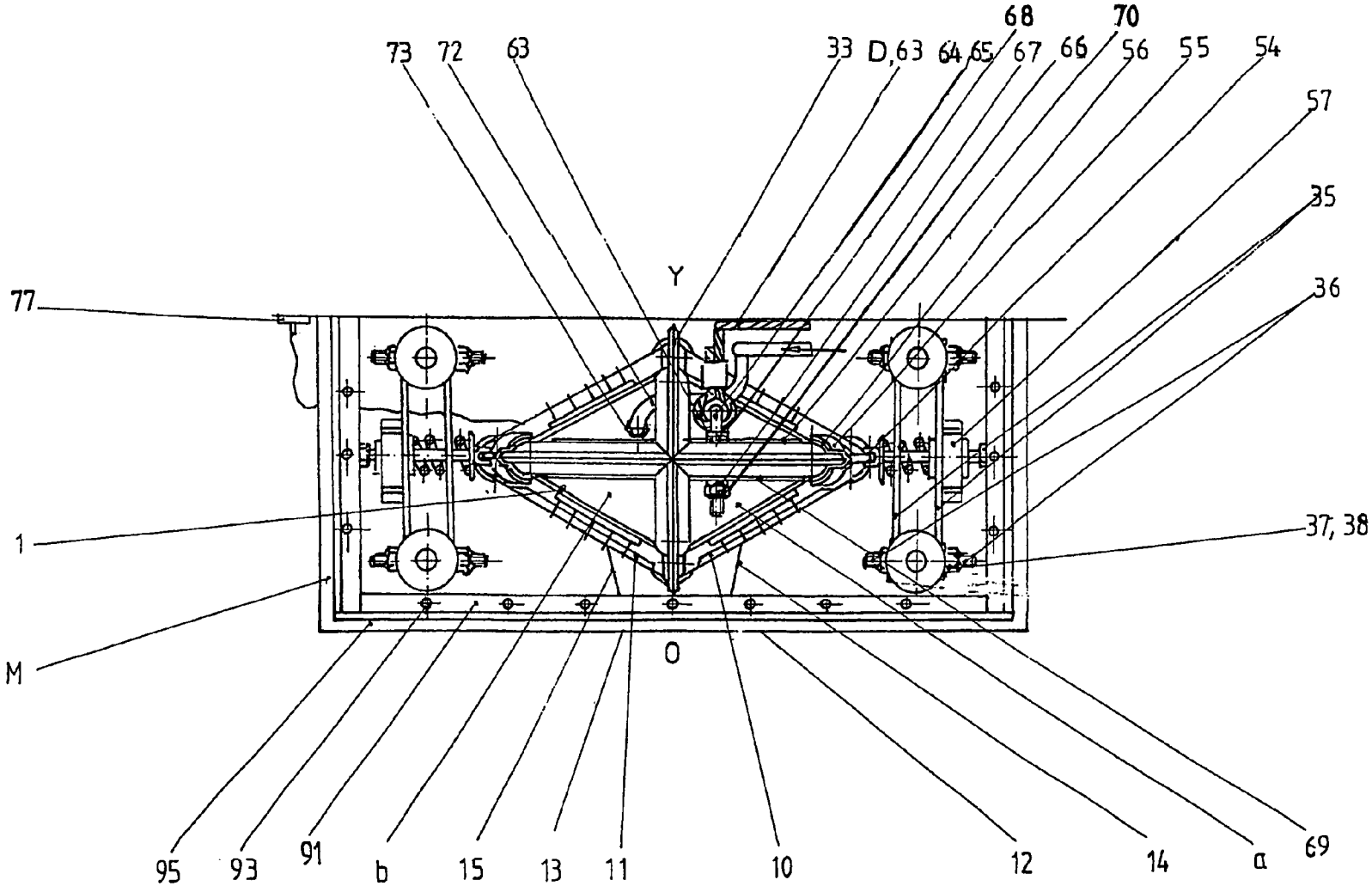
FIG. 2 is a plan view of the anti-seismic rescue apparatus of FIG. 1.

The reinforcing frame R is a metallic construction of a frame works spatially coupled in a triangular shape. The appearance of the cabin 1 is made by the four steel frames 27 with ring-shaped section placed, for example, in horizontal section, in which they occupy a rhombus shape, generating a body, the rescue cabin's body, having, from the base to the top, the shape of prism, frustum of pyramid, pyramid. Every frame 27 is made up by three sections welded under some angles for shaping the cabin 1. Every compartment of the cabin 1 has a triangle section realized by joining together the frame 27 with a steel trellis with ring-shaped section 31 and the gusset plates 32, and by welding on the side faces of the cabin 1 and on the vertical plan, which contains the small diagonal of the rhombus base (O–Y; see FIG. 2) that becomes, in this way, the separation plan between the two compartments a and b.

For safety, the space between the separation planes trellis must allow passage of a person from one cabin's 1 compartment to another.

For damping shocks and dissipation of kinetic energy of elements of the building that are hitting the cabin 1, every frame 27 is endowed on the underside with a damper 28 with impact springs and dashpot pistons 29 relying on the interior floor by some circular supporting bracket 30.

Also for dissipation of kinetic energy, each of the lateral edges of the frames 27 is endowed with a carbide tipped tool 33 for dislocating ferro-concrete blocks contacting the cabin 1 with a certain speed and for dissipation of the kinetic energy. The cabin 1 stands in vertical position because of the supporting system S that is formed by four supporting pillars 34 having a ring-shaped section, vertically placed by twos, by one side to another of the cabin 1. The pillars 34 forming a couple might have a plan-parallel movement, following the oscillation of the floors during the seismic action. This movement is possible by coupling the pillar 34 pairs with junction plates 35 that can rotate around some clevis bolts 36 fixed on the pillars 34 and free in the junction plates' 35 bore hole. They are ensured against detachment by crown nuts 37 and splints 38. At the underside, the pillars 34 have some flanges 39 fixed to floor by some concrete anchor bolts 40. Contact between the flanges 39 and the floor occurs with rubber buffers plates 41 for shock dampening. The contact with the ceiling is maintained by some slip-on flanges 42, inside which are free ends of the steel tension rods 43, the single coiled springs 44, the flanges 45, and the damping rings 46, solidly with the steel tension rods 43. The slip-on flanges 42 are ensured against detachment by some preventers 47 (disks, plates, etc.) that are slipped over the milled recesses 48. When the single coiled spring 44 is compressed to its maximum extent and the slip-on flange 42 is stopped by the flange 45 and the damping ring 46, the free end of the steel tension rod 43 made from hard material and having a conical shape will outrun, by a few centimeters, the superior level of the slip-on flange 42 resulting in a cracking of the ceiling. This situation can be met when the ceiling crumbles over the rescue apparatus 1. Such a configuration decreases the ceiling's kinetic energy because of the dampening of the damping rings 44, on one side, and the cracks done by the conical vertexes of the steel tension rods 43 protecting the rescue cabin 1, on the other side. The height of the steel tension rod 43 can be regulated by screwing on the screw nuts 49 with a variable height. The screwing is made on the adjustment holes 50, driven with help of a lever.

Vertically standing the cabin 1 by the pillars 34 is accomplished by elastic arms 51 and 52 formed by the sliding bars 53 that support at the load side by a turning joint 54, the steering pad 55 endowed on the interior side with two cover plates made from antifriction material 56 that are permanently maintained in elastic contact with the cabin 1. The sliding bars 53 slide inside the two bore holes of the bracket support 57 equipped with oilite bushing 58. The elastic contact is ensured by the single coil springs 59 that lean on the spring hanger 60 solidly with the sliding bars 53 at one end and, on the other end, lean on the bracket support 57 so that oscillations of the cabin 1 are taken over by the single coil springs 59. The free ends of sliding bars 53 are thread-cutting-equipped with crown nuts 61 and splints 62.

The supporting system S of the cabin 1 will oscillate together with the reinforced-concrete floors with the seismic motions and will maintain the cabin 1 in vertical position, protecting the room on the contact zones upon earth tremors. If it is necessary, the supporting system S can easily set free the rescue cabin 1.

When the seismic motion becomes very strong, leading to the destruction of the vertical structural elements of the building, normally, the reinforced-concrete ceiling, because of gravitational forces, will react on the supporting system S to produce a damping and a perforation of the superior reinforcement concrete floor by the steel tension rod 43, which decreases the kinetic energy of the first vertical hitting by the ceiling and protects the rescue cabin 1.

In case the building caves in and the cabin 1 is caught under wreckage, a towing device D formed by a wire cable 63 is provided and has a section large enough to support the tensile stress for quarrying out the cabin 1 from the wreckage.

The wire cable 63 is fixed on the rescue cabin 1 by the draw hook 64, with protection against cable detachment 65, the draw hook 64 being fixed on the superior side of the cabin 1 on the plates 69 and 70 by the screw nut 66, spring washers 67, and the axle collar 68.

The free end of the cable 63 is caught outside the room through a hole made on the exterior wall of the room—for example, the front wall, in the upper corner of the room, going vertically on the front of the building and being fixed above in the highest point of the building that it is supposed to remain over ground after the wall caves in. The cable 63 is marked from meter to meter all along, starting from the top of the cabin 1. If it would be necessary, by stretching, the end of the cable 63 over ground, the marking will indicate the distance where the cabin 1 is immobilized under the wreckage.

On the superior end of the cable 63 fixed above the building, a non-illustrated designation card is attached and has marked on it the owner's name, the housing's number, the floor, the relative position of the cabin 1 to the front of the building, the phone call number from the cabin, etc. The wire cable 63 routes will be masked inside and outside the room.

In case the building has caved in and the rescue cabin 1 is caught under the wreckage, the cabin 1 is equipped with measures for survival, for communication with the exterior, and for disengagement, which are fixed in the compartments c, d, e, and f.

Figure 4:
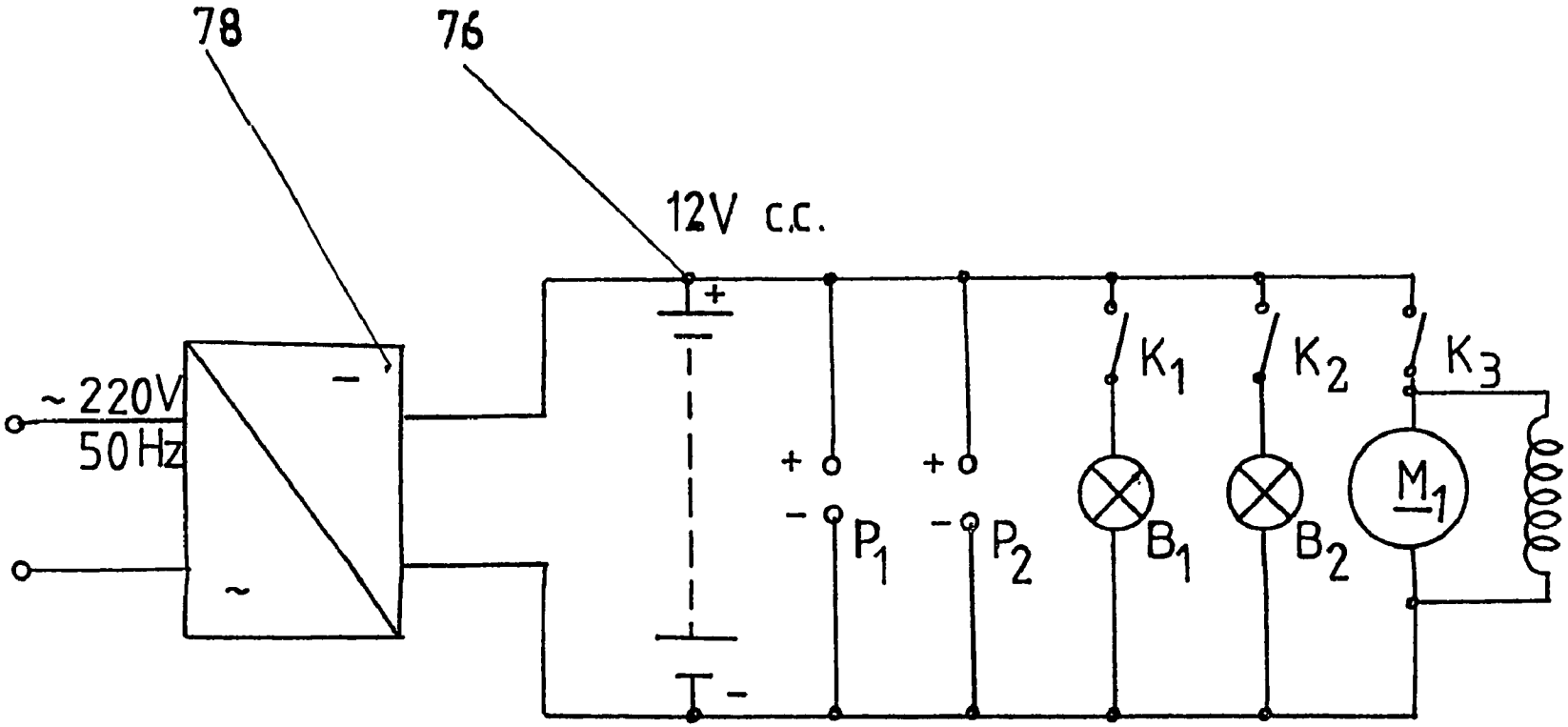
FIG. 4 is a block and schematic circuit diagram of a simplified electric installation of the rescue apparatus of FIG. 1.

For insuring air flow in the cabin 1, if the windows 23 do not function, the cabin 1 is provided with a low pressure compressor having a diaphragm 71, driven by a single-phase commutator motor MI at 12 v, that absorbs the air from outside through a wire wrapped rubber hose 72, and delivers air under pressure inside the cabin 1 where the hose 72 end is fixed by the reducing sleeve 73. The hose 72 follows the route of the wire cable 63 until a given point and is fixed on the front of the building, at which loading end is a dust catcher 74 protected by a filter container 75 against deformations and pluvial waters. The motor MI is supplied by an accumulator 76 having good leakage properties (see FIG. 4) of 12 v and it is commanded by a starting switch K3. The accumulator 76 can be charged on the 220 v mains 77 (or other voltage) placed outside the cabin 1 with an optimized charging rectifier 78.

In the cabin 1, there are two electric light lamps B1 and B2 at 12 v placed on the ceiling of every compartment commanded by two switches K1 and K2. See FIG. 4.

In the 12 v electric circuit, there are two more convenience outlets: P1 inside the cabin 1 for charging a mobile phone 79 and a radio transceiver 80, for example, that are provided also with their own batteries, and P2 mounted laterally outside on the wall of the furniture part M that can energize some appliances used at 12 v for optimizing the execution cycle of the accumulators 76.

The rescue cabin 1 is equipped with one or two battery lamps 81, two mine-breathing masks 82, which can be used in critical moments, a first-aid kit 83, a fire extinguisher 84, a high-power hydraulic jack 85, a shovel 86, an accessory kit 87, and structural tongs 88 for disengaging the cabin 1 out of the ruins by its own measures.

Into the compartment f there are placed a metallic case 89 where valuables can be kept, such as deeds, estate documents, money, jewelry, but also instructions for acting in critical situations, the Bible, etc.

For subsisting through a period of time in specific situations of captivity, the rescue cabin 1 also includes preserved food and bottled water 90, blankets 91 to resist against hypothermia, substances for neutralization and hygiene 92, toilet paper 93, and boxes 94 for elimination of human defecations and mictions, the boxes being made of plastic, having a cylindrical shape, with threading lid, made by dimensional levels such as they can be introduced one into another and all together into only one box, the biggest one.

The whole apparatus, installations, devices, and materials will be protected against shocks and will be fixed well into their respective compartments for not detaching on shocks and not producing harm to the people in the rescue cabin 1.

The whole system is camouflaged into a piece of furniture M that has the shape of a wardrobe with four superior doors and four inferior doors, made by solid wood or imitation wood in the same stylistic line with the existent furniture of the house. The inferior central doors 12 and 13 open together with the two doors 10, 11 of the rescue cabin 1. Into the sidewalls of the furniture piece are made oblong holes g and h, to permit oscillation of the elastic arms 51 and 52.

The furniture piece is fixed on the ceiling and on the floor by some wood support frames 95 and 96 with fixing bolts 97 and 98 and have applied on outside thereof the wood cornices 99 and 100. The furniture piece M has a low mechanic resistance and can be intended to be destroyed in the same time with the exterior.

On a side wall of the furniture piece M will be posted a table for scheduling the water and food reserves, checking the accumulator's normal state, the extinguisher, the mobile phone, etc.

The anti-seismic apparatus is placed into a dwelling and/or a social-cultural-office building in easy accessible places, where it will remain permanently.

When the seismic opening moment starts or an integrated pager warns the users about imminent starting of the seismic activity, if this possibility exists, the people in the room will run up into the rescue cabin 1.

Operation thereof can take place as set forth in the following text.

The exterior doors 12, 13 are opened together with inner doors 10, 11, and the users enter the rescue cabin 1, sit down on the chairs 3. The cabin's doors 10, 11 are shut and locked and the full safety harness 6 and crash helmets 7 are put on. The light lamps B1 and B2 are turned on (manually or automatically) and the users wait for later developments. The users can be provided with non-illustrated handles placed on the walls of the cabin 1 for comfort.

If the seismic activity was not so catastrophic, at the end of the tremor, the users could leave the rescue cabin 1.

In the undesirable case of a crumbling of the building, the anti-seismic rescue apparatus' main role is to protect its occupants from shocks and direct hits, because, in the end, they must be safe and alive.

From this moment on, their rescue, using a good communication and coordination with the exterior may be only a question of time and can be accomplished if the cabin 1 is quarried out from the ruins by a power-driven winch or other power-propelled vehicles, using the wire cable 63, or by a rescue team getting into the place where the cabin 1 is immobilized, and directly saving the respective user by the disengagement measures when the cabin 1 is nearly to the surface.

Meanwhile, the occupants of the cabin 1 can feed themselves, use the first aid kit to give the first aid to one another, listen to the radio, communicate with the exterior, read, rest, and/or protect themselves from cold, thereby satisfying their own physiological necessities.

I claim:

1. An anti-seismic rescue apparatus to be placed in a room of a structure for protecting at least one occupant from shocks and impacts during seismic activity, for ensuring communication with the environment, for improving survival of the occupant from seismic activity during a period of time, and for improving conditions for a faster rescue of the occupant and their valuables caught inside the damaged structure, the apparatus comprising:

a rescue device having:

a rescue cabin defining an interior for accommodating at least one occupant and having in said interior survival devices for surviving burial and for assistance in rescue;

a reinforcing frame protecting said rescue cabin from at least a first impact caused by seismic activity, said reinforcing frame being a metallic construction of spatially coupled triangular-shaped frame works;

an external supporting system having connections releasably connected to said reinforcing frame for releasing said rescue cabin from said supporting system; and at least one of said reinforcing frame and said supporting system maintaining said rescue cabin in a substantially vertical position while the room keeps its integrity;

a piece of furniture containing said rescue cabin therein and camouflaging said rescue cabin to harmonize said rescue cabin with an existing environment of the room; and a towing device connected to said rescue cabin for locating said rescue cabin and for quarrying out said rescue cabin from wreckage, said towing device being a rescue cable.

2. The anti-seismic rescue apparatus, according to claim 1, wherein said rescue cabin has reinforcement plates and an exterior surface covered by said reinforcement plates and is upholstered inside with plastic fire-resisting material protecting occupant body zones from harm, said reinforcement plates being formed of corrugated iron.

3. The anti-seismic rescue apparatus, according to claim 1, wherein:

said rescue cabin defines two compartments each for lodging one person;

each of said compartments has:

a chair with a backrest, side head protection, a headrest, a safety harness, and a crash helmet for damping shocks; and a damper spring connecting said chair to said rescue cabin; and said rescue cabin has columns permitting vertical oscillations and placed between said two compartments.

4. The anti-seismic rescue apparatus, according to claim 3, wherein deposit compartments are disposed under said chairs and are covered with protecting covers.

5. The anti-seismic rescue apparatus, according to claim 3, wherein:

said rescue cabin has two revolving access doors, one for each compartment;

said furniture having two revolving doors; and a linkage connecting one of said two revolving access doors of said rescue cabin to one of said revolving doors of said furniture permitting closing and opening together in a plane-parallel movement.

6. The anti-seismic rescue apparatus, according to claim 5, wherein said two revolving access doors open in opposite directions and vertical rotation axles.

7. The anti-seismic rescue apparatus, according to claim 5, wherein said two revolving access doors each have a recessed locking mechanism actuated from said interior and an exterior of said rescue cabin.

8. The anti-seismic rescue apparatus, according to claim 5, wherein:

said rescue cabin has side walls; and said two revolving access doors have a framework structure and sub-frames of steel connected to said side walls.

9. The anti-seismic rescue apparatus, according to claim 1, wherein said rescue cabin has:

an exterior surface with plates; and an upper part with a plurality of circular windows for ventilation, each of said windows having:

a screen filter for preventing entry of dust into said interior through said windows; and a linear shim protecting said windows from strikes and against obtrusion, said shim being disposed at said exterior surface of said rescue cabin on said plates.

10. The anti-seismic rescue apparatus, according to claim 1, further comprising:

dampers each having an impact spring, a normal axle on ground, a circular supporting bracket, and a dashpot piston lying on said supporting bracket for decreasing pressure on a floor below said rescue cabin; and each of said frames having an upper part, a side, and three sections welded in angles and joined together at said upper part into a pyramidal pike and connected to said damper at said side.

11. The anti-seismic rescue apparatus, according to claim 10, wherein:

said rescue cabin has a body shaped from base to top thereof selected from the group consisting of a prism, a frustum of a pyramid, and a pyramid; and said frames are spatially disposed to form a rhombus in horizontal section and to vertically form said body of said rescue cabin.

12. The anti-seismic rescue apparatus, according to claim 11, wherein:

said rescue cabin defines two compartments;

a steel trellis with a ring-shaped section and gusset plates unites said frames by welds on said side walls of said rescue cabin and on a vertical plane containing a diagonal of said rhombus base that becomes a separation plane between said two compartments;

said trellis and said frames form a substantially indestructible structure spatially coupled in a triangle-shape; and said frames have lateral edges on which are mounted carbide tipped tools for dislocation of ferroconcrete blocks contacting said rescue cabin at a given speed and for dissipating kinetic energy therefrom.

13. The anti-seismic rescue apparatus, according to claim 1, wherein:

said supporting system has four steel supporting pillars with a ring-shaped section; and said pillars are disposed in pairs on respective sides of said rescue cabin.

14. The anti-seismic rescue apparatus, according to claim 13, further comprising:

clevis bolts, crown nuts, and splints; and junction plates coupling said pillars and being attached thereto with said clevis bolts, said crown nuts and said splints, attachment of said junction plates to said pillars enabling a plan-parallel movement of pairs of said pillars to imitate oscillations of a floor during an earthquake.

15. The anti-seismic rescue apparatus, according to claim 14, wherein:

said pillars having flanges, concrete anchor bolts and rubber buffer plates for contacting the pillars to a floor below said rescue cabin; and said concrete anchor bolts fix said flanges with said rubber buffer plates sandwiched between said flanges and the floor for damping seismic shocks.

16. The anti-seismic rescue apparatus, according to claim 15, wherein:

said pillars have preventers, single coiled springs, damping rings, screwing nuts, steel tension rods with adjustment holes, slip-on flanges with milled recesses, and further flanges for contacting said pillars to a ceiling above said rescue cabin; and said steel tension rods have a length adjusted by said adjustment holes with a turning of said screwing nuts.

17. The anti-seismic rescue apparatus, according to claim 16, wherein said rescue cabin has elastic arms that, with said pillars, maintain said rescue cabin in a vertical position at least as long as the room in which said rescue cabin resides keeps its integrity.

18. The anti-seismic rescue apparatus, according to claim 17, further comprising:

sliding bars, turning joints, steering pads, cover plates of an antifriction material, bracket supports, junction plates with coaxial holes filled with oilite bushings, single coil springs, spring hangers, crown nuts, and splints;

said cover plates being in permanent elastic contact with said rescue cabin;

each of said elastic arms having a load side, an interior side, and sliding bars supporting said arms at said load side through said turning joint;

said steering pad being disposed on said interior side of said arms with said cover plates;

sliding bars slipping over inside said bracket support with one of said exterior junction plates and having free ends with threads, oscillations of said rescue cabin being transmitted to said sliding bars;

coil springs solidly leaning on said spring hanger with said sliding bars and ensuring elastic contact of said arms; and said crown nuts and splints fitting on said threads of said sliding bars.

19. The anti-seismic rescue apparatus, according to claim 1, wherein said towing device is a wire cable having a cross-section sufficient to support a tensile stress tension for quarrying out said rescue cabin from wreckage of the structure.

20. The anti-seismic rescue apparatus, according to claim 19, wherein:

said rescue cabin has plates and a top;

said towing device has a screw nut, spring washers, and an axle collar fixed on said plates; and a draw hook is fixed adjacent said top of said rescue cabin with protection against cable detachment formed by said screw nut, said spring washers, and said axle collar.

21. The anti-seismic rescue apparatus, according to claim 20, wherein said cable:

has a fixed end connected to said rescue cabin by said draw hook;

has a free end to be secured outside the structure through a hole made into an exterior wall of the room, and to be disposed vertically on a front of the structure and be fixed thereabove at a point of the structure to remain outside after the structure crumbles; and is marked from meter to meter starting from said top of said rescue cabin to said free end to indicate a distance from a rescuer to said rescue cabin.

22. The anti-seismic rescue apparatus, according to claim 21, wherein said free end has a designation card with identifying indicia.

23. The anti-seismic rescue apparatus, according to claim 22, wherein said identifying indicia include at least one of the group consisting of an owner's name, a residence number, a floor, a relative position of said rescue cabin to a front of the structure, and a phone number of said rescue cabin.

24. An anti-seismic rescue apparatus to be placed in a room of a structure for protecting at least one occupant from shocks and impacts during seismic activity, for ensuring communication with the environment, for improving survival of the occupant from seismic activity during a period of time, and for improving conditions for a faster rescue of the occupant and their valuables caught inside the damaged structure, the apparatus comprising:

a rescue device having;

a rescue cabin defining an interior for accommodating at least one occupant and having in said interior survival devices for surviving burial and for assistance in rescue, said rescue cabin having at least one door selectively opening and closing off said interior for access to and egress from said interior by the occupant;

a reinforcing frame protecting said rescue cabin from at least a first impact caused by seismic activity, said reinforcing frame being a metallic construction of spatially coupled triangular-shaped frame works;

an external supporting system having connections releasably connected to said reinforcing frame for releasing said rescue cabin from said supporting system after a given force is exerted through said connections; and at least one of said reinforcing frame and said supporting system maintaining said rescue cabin in a substantially vertical position while the room keeps its integrity;

a piece of furniture containing said rescue cabin therein and camouflaging said rescue cabin to harmonize said rescue cabin with an existing environment of the room; and a towing device connected to said rescue cabin for locating said rescue cabin and for quarrying out said rescue cabin from wreckage, said towing device having a structure sufficient to quarry out said rescue cabin from wreckage, said towing device being a rescue cable.

25. The anti-seismic rescue apparatus, according to claim 1, further comprising a shock absorption system for damping hits and vertical failings suffered by said rescue cabin and the occupants of said rescue cabin.

26. The anti-seismic rescue apparatus, according to claim 1, further comprising a venting system for providing air flow for the occupants of said rescue cabin in burial conditions.

27. The anti-seismic rescue apparatus, according to claim 1, further comprising a pyramidal peak formed on an upper part of said rescue cabin for dislocating ferro-concrete elements hitting said rescue cabin.

28. The anti-seismic rescue apparatus, according to claim 1, further comprising at least an electrical equipment with proper electrical power supply providing electrical energy to the occupants of said rescue cabin for surviving burial.

* * * * *